US006536382B1

(12) United States Patent
Wilksch

(10) Patent No.: US 6,536,382 B1
(45) Date of Patent: Mar. 25, 2003

(54) RADIATOR FOR INVERTED AIRCRAFT ENGINE CONFIGURATION

(75) Inventor: Mark Conrad Wilksch, Buckingham Bucks (GB)

(73) Assignee: Seneca Technology Ltd. (KN)

( * ) Notice: Subject to any disclaimer, the term of this patent is extended or adjusted under 35 U.S.C. 154(b) by 0 days.

(21) Appl. No.: 09/552,393

(22) Filed: Apr. 19, 2000

(30) Foreign Application Priority Data

Apr. 19, 1999 (GB) ..... 9908845

(51) Int. Cl.[7] ..... F01P 3/18; F01M 5/00

(52) U.S. Cl. ..... 123/41.48; 123/41.52; 165/44; 165/51; 244/57

(58) Field of Search ..... 60/904; 165/41, 165/44, 51; 123/41.52, 41.49, 41.48, 41.65, 41.7, 58.1; 244/57, 65

(56) References Cited

U.S. PATENT DOCUMENTS

| | | | | | |
|---|---|---|---|---|---|
| 1,386,493 | A | * | 8/1921 | Guyot | 123/41.48 |
| 1,464,765 | A | | 8/1923 | Junkers | |
| 1,545,505 | A | * | 7/1925 | Loening | 123/41.48 |
| 1,941,974 | A | | 1/1934 | Davis | |
| 2,164,545 | A | * | 7/1939 | Rogers | 123/41.59 X |
| 2,271,994 | A | | 2/1942 | Allen | |
| 3,921,603 | A | * | 11/1975 | Bentz et al. | 123/41.33 |
| 4,066,047 | A | * | 1/1978 | Vidakovic et al. | 123/41.12 |
| 4,377,203 | A | * | 3/1983 | Ejima | 165/125 |
| 4,620,515 | A | * | 11/1986 | Marin | |
| 6,145,479 | A | * | 11/2000 | Rotter | 123/41.49 |

FOREIGN PATENT DOCUMENTS

| | | | |
|---|---|---|---|
| DE | 656 565 | C | 3/1936 |
| FR | 593 062 | | 8/1925 |
| GB | 527018 | | 10/1940 |
| GB | 552164 | | 9/1942 |
| GB | 552164 | * | 3/1943 |

* cited by examiner

*Primary Examiner*—Tony M. Argenbright

(57) ABSTRACT

An inverted aircraft internal combustion engine, such as a two-stroke compression-ignition (diesel) engine, incorporates a lubricant (oil) and/or coolant heat exchanger mounted upon the engine below an exposed crankshaft and/or enclosed crankshaft housing and adjacent a propeller mounting location.

20 Claims, 2 Drawing Sheets

RADIATOR FOR INVERTED AIRCRAFT ENGINE CONFIGURATION

TECHNICAL FIELD

This invention relates to internal combustion engines and the disposition of ancillary components, and more particularly to coolant system heat exchanger location for inverted engines for aircraft propulsion.

BACKGROUND

The term "radiator" is used herein to embrace any form of heat exchanger and is not restricted to a particular form or mode of heat transfer; in fact, radiation is not a significant mode compared with conduction and convection. A particular example is a liquid/air radiator, with a honeycomb matrix of vanes (of large collective surface area) about a convoluted network of tubular flow passages between a supply tank and a collection tank. Heat transfer is primarily by conduction and (forced) convection to a (generally forced) air flow across the vanes and flow passages.

The diversity of multi-cylinder configurations for aircraft piston engines—typically with a single, common crankshaft—include, for example: a single-file row (i.e. an "in-line" configuration); multiple, discrete, angularly-splayed, or angularly offset, rows (albeit there may be only one cylinder in each row)—such as a "V" or "W" configuration; in rows opposed, either horizontally, vertically, or at some other angle (e.g. a flat configuration); and individually, around a common crankshaft axis, generally equi-angularly spaced, in one or more planes (e.g. a "radial" configuration). There also have been some engines with multiple crankshafts, for example, with cylinders arranged in an "H" configuration (in effect, two flat engines sharing a single common crank-case), or with two pistons per cylinder, working in opposition, in various opposed-piston arrangements.

It is known to "invert" an in-line, or "V" configuration—so that the cylinders are below the crankshaft. A prime advantage of such engine inversion, for aircraft propeller propulsion, is that the crankshaft sits higher on the engine and so a propeller mounted directly upon it will be farther from the ground. At critical flight phases of take-off and landing, it is important to maintain adequate clearance between propeller and ground. The object is to reduce the chance of accidental propeller damage, allowing for undercarriage travel and fuselage forward tipping moment about the undercarriage.

Other ways to improve ground clearance include lengthening the undercarriage, in order to raise the whole aircraft further from the ground, reducing the diameter of the propeller, and raising the engine installation in the aircraft. All of these have drawbacks, however. It is thus well-established for smaller aircraft that use directly-driven propellers (i.e. propellers mounted directly upon a crankshaft end), to use an inverted engine arrangement.

Waste heat from an internal combustion (IC) engine has to be transferred to its surroundings, in one way or another.

For most engines, (except in marine use) the only convenient way to dispose of this heat is to transfer it to the surrounding air. Such heat transfer can be directly from the engine components (i.e. "air-cooling") in which case the components are usually made with fins to provide a greater surface area for heat transfer by conduction and convection.

Heat transfer can also be through an intermediate fluid, such as oil, water, and/or ethylene glycol, circulated around the various parts of the engine in order to collect heat then passed to a heat exchanger ("radiator") , where the heat is transferred to the air. The extra complexity of providing an intermediate fluid for cooling is a disadvantage, but it enables a reduction in the temperatures of key components, thus allowing a given size engine to be made more powerful, more reliable and longer-lasting. It is essential that the cooling system be made extremely reliable, since engine componentry that is not effectively cooled will overheat and fail rapidly.

The heat exchanger (or radiator) usually comprises a series of finned tubes and fluid collectors at each end of these tubes. The fins provide the large surface area required for transfer of the heat, by convection to the air. The radiator may be made in discreet sections (each of which may comprise a number of tubes and their associated fins), which are then assembled into a single unit.

Typically a fan, or multiple fans, are used to increase the velocity of the air over the fins of the radiator, hence improving the heat transfer coefficient and allowing a smaller radiator to be used. For vehicles, the movement of the vehicle may be sufficient to provide the relative air velocity, although a fan, or multiple fans, are often used as well.

In the specific case of aircraft engines, the velocity of the aircraft once flying is usually sufficient that a fan is not necessary. The air-displacement, thrust action of a propeller itself provides a very convenient high velocity flow of air that can easily be used to advantage—especially when the aircraft is stationary on the ground, or has a low airspeed when climbing.

The engine lubricating oil is not usually the primary coolant, but often becomes hot, because of its contact with the high temperature components in the heart of the engine and the frictional heat that is generated at various component sliding contact surfaces. Engine oil is thus often cooled by its own dedicated cooler which may transfer the heat directly to the air, in a heat exchanger radiator or to an intermediate fluid, and thence to the air.

Many different locations for coolant and oil cooling radiators have been adopted. While a lubricant (oil) radiator is generally smaller, and is often mounted to the engine assembly, a coolant radiator is usually mounted elsewhere upon the airframe, for example, under the fuselage, inside the fuselage, under, or inside, the wing structure, etc. Smaller inverted aircraft engines have often been air-cooled, with no requirement for a coolant radiator. Where a lubricant (oil) radiator has been used, it is generally mounted towards the rear of the engine, or upon the airframe remote from the engine.

Some flat (horizontally opposed) engines have used oil radiator locations below and beside the engine crankshaft axis, and toward the front of the engine. Larger inverted engines have been liquid-cooled, but with radiators for coolant and lubricant (oil) mounted upon the airframe, remote from the engine.

SUMMARY OF THE INVENTION

According to the present invention, a fluid coolant heat exchanger, such as a radiator matrix or honeycomb, is mounted directly upon an engine or engine casing, at a location below a crankshaft axis, of an inverted internal combustion (IC) engine. In practice, the coolant fluid is a liquid, conveniently water, albeit with corrosion and freezing inhibitor agents, such as alcohol, or ethylene glycol. Alternatively, for severe low-temperature duty an entirely synthetic coolant may be employed.

Such a radiator location is conveniently adopted with special, or dedicated engine features, for example, a (forward) extension of the crankshaft and crankcase (nose), to allow room for the radiator and associated airstream. Although this involves some additional engine cost and complexity, considerable benefits accrue to an integrated engine cooling system which have surprisingly been found to outweigh apparent disadvantages.

The radiator can be used for cooling either coolant, lubricant (oil), or both (on a combined unit) so the heat exchanger location is applicable to either a primarily liquid or air-cooled engine. The radiator can be conveniently attached to the engine structure, either directly, or indirectly, by compliant mountings, that help prevent, absorb, or suppress, transmission of (potentially) damaging vibration from the engine structure.

The location according to the invention allows conveniently short and direct connection of fluid lines (if required) between engine and radiator with the benefits of reduced cost, installation time and skill and reduced risk of leaks. For aircraft, risk reduction is of paramount importance. Further, it allows direct passage of cooling air, from behind a propeller "disk", through the radiator without the need for additional ducting.

The radiator can desirably have extensions, in order to make use of any available space around the front of the engine with bespoke complementary profiling to fit around other components and auxiliaries.

With a radiator mounted directly upon the engine structure, with or without compliant mountings, direct connecting passages can be used thereby eliminating hoses, other fittings, or connections, with reduction in cost, installation time, and risk of fluid leakage.

On "pusher" aircraft types, where the propeller is at the rear of the engine, air can first be ducted into the engine compartment and be exhausted through the radiator for onward flow through the propeller disk.

BRIEF DESCRIPTION OF THE DRAWINGS

There now follows a description of some particular embodiments of the invention, by way of example only, and with reference to the accompanying diagrammatic and schematic drawings, in which.

DESCRIPTION OF THE PREFERRED EMBODIMENT(S)

Figure 1:
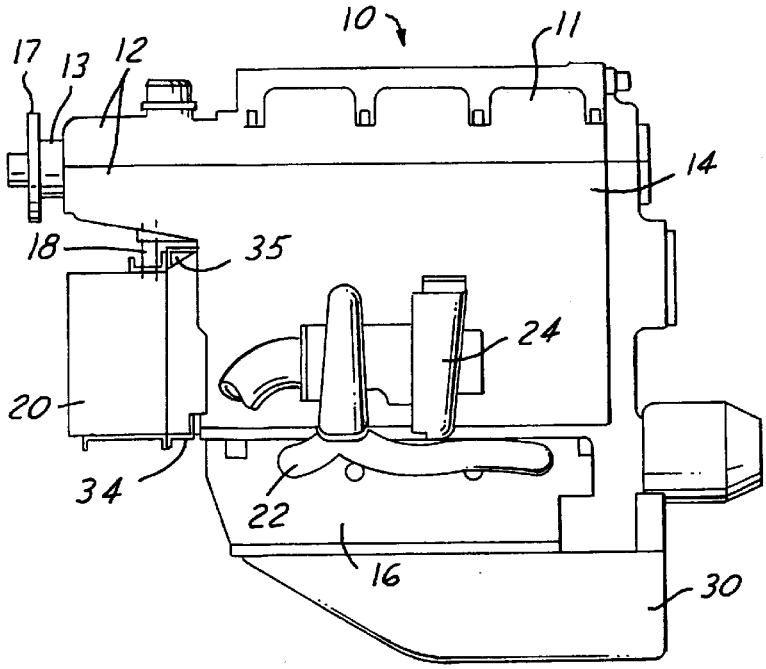
FIG. 1 shows a side view of a radiator mounted to an inverted (turbocharged) aircraft engine.

As shown in FIG. 1, the aircraft engine 10 includes a sump 30 attached to a cylinder head 16, to which is also attached an exhaust manifold 22 carrying a turbo-supercharger 24. The cylinder head is itself attached to the crankcase 14, which is closed at its upper face by a crank cover 11. The crankcase 14 and crank cover 11 both have extensions 12, which support (through bearings) the crankshaft 13, which is extended beyond the faces of the crankcase 14 and crank cover 11 and terminates in a flange 17 which may be used to connect to a propeller (not shown) or the like.

The space beneath the crankcase/crank cover extensions 12 is used for a radiator 20, which is mounted via mounts to the crankcase and/or cylinder head and/or crank cover. Coolant passes between the radiator 20 and the rest of the engine via passages 18. Intermediate brackets 34 and 35, may be placed between the radiator mounts and the engine casings or between the radiator and the radiator mounts as appropriate.

The mountings 34 and 35 could incorporate resiliently deformable bushes and/or flexible straps, hangars or ties. In this way reliance need not be placed upon any surrounding airframe or other structure, and the engine and radiator constitute a compact, self-contained, integrated, module. Such (compliant) mountings can desirably incorporate passages for the transfer of coolant, between engine and radiator.

Figure 2:
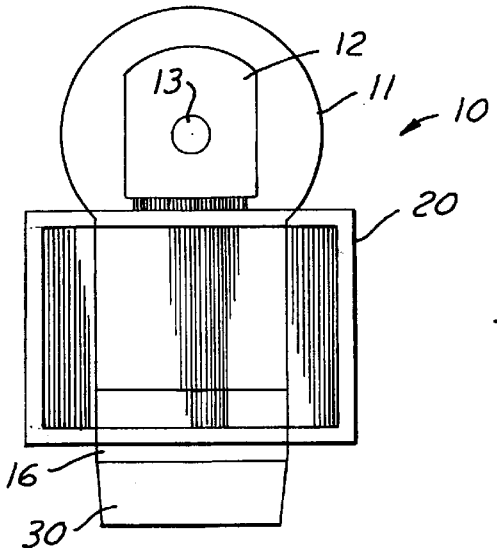
FIGS. 2 and 3 show an engine with a radiator mounted upon resilient mountings.
Figure 3:
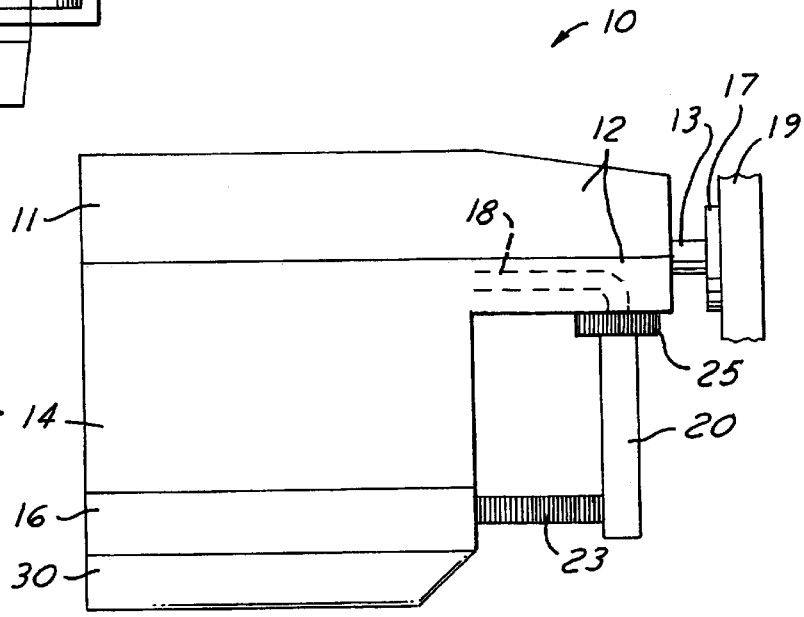

FIGS. 2 and 3 show the engine 10 with the radiator 20 mounted upon resilient mountings. The radiator 20 is supported by resilient mounts 23 and 25, which are attached to the crankcase extension 12 by suitable fasteners (not shown).

The crankshaft 13 carries a hub for the attachment of a suitable propeller 19 (shown in part) for propulsion of an aircraft (not shown). The coolant passages 18 transfer the coolant between the radiator and the rest of the engine.

Figure 4:
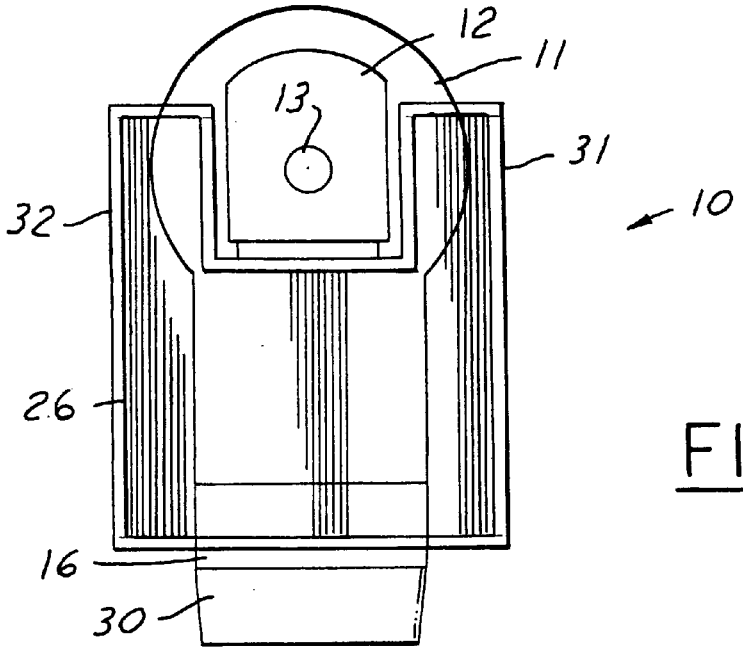
FIG. 4 shows an engine with a radiator shaped to fit around the crankcase extension.

FIG. 4 shows the engine 10 with radiator 26 suitably shaped to fit around the crankcase extension. In this figure the components are very similar to those of the previous figures except that the radiator 26 is extended up and to each side of the crankcase/crank cover extensions 12. The radiator extensions at 31 and 32 providing extra area for passage of the cooling air. With this embodiment a greater amount of waste heat may be removed from the coolant either to allow for a higher power output from the engine, or to allow for adverse conditions, such as are encountered in warmer climates.

Figure 5:
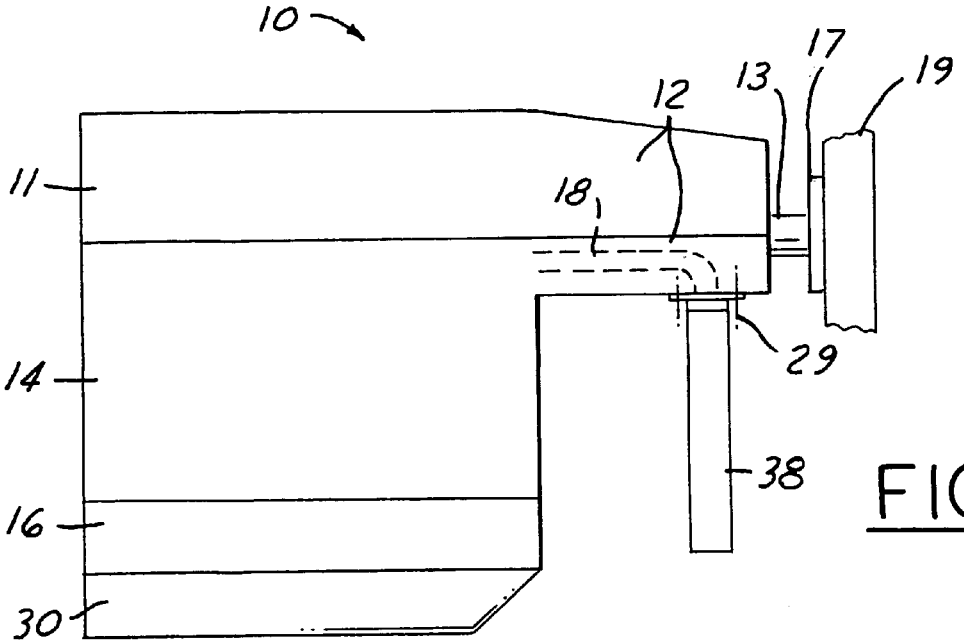
FIG. 5 shows an engine with a radiator mounted directly to the structure.

FIG. 5 shows the engine 10 with a radiator 38 mounted directly to the structure and with coolant passages transferring coolant directly between the two. The radiator 38 has a flange or flanges (or other suitable connection points) which are clamped to the crank cover 11 (or crankcase 14) extension 12 by fasteners 29. In this case the coolant passages 18 may be internal to the crankcase/crank cover extension 12 thereby removing any need for external coolant pipes or hoses.

The aforementioned features apply to an engine of generally "inverted" configuration that could in addition (but not exclusively) include any of the following features:

- two, or four-stroke combustion cycles;
- high, or low-mounted camshafts;
- multiple cylinders;
- compression-ignition ("diesel") combustion;
- spark-ignition combustion;
- liquid fuel (e.g. gasoline, kerosene, fuel oil or liquefied petroleum gas);
- gaseous fuel;
- integral sump lubrication (also know as "wet" sump lubrication);
- a lubrication system using a separate sump or oil catch tank (also known as "dry" sump lubrication);
- a mechanically-driven super-charger, or multiple super-chargers;
- a supercharger or turbo-supercharger or combinations thereof; and/or a downstream turbine geared to provide extra power to the crankshaft (usually known as "turbo-compounding").

By placing the radiator at the front (for "tractor" installations) of the engine good air flow through the radiator is obtained by direct "pitot" recovery of dynamic pressure from the free airstream without the need for additional ducting or a plenum chamber. A pitot pressure recovery system has the advantage that effectiveness of cooling flow can be achieved without the need for a plenum chamber with associated baffles and sealing strips. Thereby a particularly simple and advantageous installation can be achieved, significantly reducing cost.

In addition, the radiator position in accordance with the present invention advantageously allows heated air to flow from the radiator thence over other parts of the engine assembly such as the exhaust system and turbocharger (if fitted) thereby cooling these components without the need for provision of additional localized cooling. Because the air from the radiator is still relatively cooler than the exhaust system components, this air is effective in cooling exhaust components despite being a waste product of the primary engine cooling system.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. An inverted engine for an aircraft, said engine comprising a crankshaft for rotating a propeller, said crankshaft having an extension, a propeller mounted on said crankshaft extension, and a radiator mounted to the engine below said crankshaft extension adjacent to the propeller mounting location.

2. The inverted engine as set forth in claim 1 wherein said radiator is shaped to fit around said crankshaft extension.

3. The inverted engine as set forth in claim 1 wherein said radiator comprises an integrated assembly of multiple individual sections.

4. The inverted engine as set forth in claim 1 wherein said radiator is mounted to said engine with compliant mounts.

5. The inverted engine as set forth in claim 1 wherein said radiator is mounted to said engine with non-compliant rigid mounts.

6. The inverted engine as set forth in claim 1 further comprising mounts mounting said radiator to said engine and coolant transfer passages to inter-connect the engine and said radiator through said mounts.

7. The inverted engine as set forth in claim 1 wherein said radiator is mounted directly upon the engine.

8. The inverted engine as set forth in claim 1 wherein said engine is configured for at least partial air cooling.

9. The inverted engine as set forth in claim 1 wherein said engine is a two-stroke combustion cycle engine.

10. The inverted engine as set forth in claim 1 wherein said engine is a four-stroke combustion cycle engine.

11. The inverted engine as set forth in claim 1 wherein said engine is configured for compression ignition.

12. The inverted engine as set forth in claim 1 wherein said engine is configured for spark ignition.

13. The inverted engine as set forth in claim 1 wherein said engine is an internal combustion engine with pistons and cylinders in an in-line configuration.

14. The inverted engine as set forth in claim 1 wherein said engine is an internal combustion engine with pistons and cylinders arranged in cylinder banks in a "V" configuration.

15. An inverted engine for aircraft propulsion, said engine having a crankshaft with an end, a propeller mounted on said crankshaft end, a radiator mounted below said crankshaft, and whereby cooling air flows through said radiator in a direction generally parallel to the engine crankshaft axis then to an engine bay containing said engine.

16. An inverted aircraft engine for a pusher propeller aircraft, said engine having a first end adjacent the aircraft and a second end positioned at a distance from the aircraft, a crankshaft having a longitudinal axis and having an extension protruding from said second end of said engine, a propeller mounted on said extension, and a radiator mounted to said engine below said extension and adjacent to said propeller mounting position, wherein air flow is initially past the engine then through said radiator in a direction generally parallel to said crankshaft axis before passage through the propeller.

17. An inverted engine for an aircraft, said engine comprising an extended crankshaft for rotating a propeller, a crankcase extension, and a propeller mounted on said crankshaft, said engine comprising a radiator mounted to the engine below said crankcase extension adjacent to the propeller mounting location, wherein said radiator is shaped to fit around said crankcase extension.

18. An inverted engine for an aircraft, said engine comprising an extended crankshaft for rotating a propeller, a crankcase extension, and a propeller mounted on said crankshaft, said engine comprising a radiator mounted to the engine below said crankcase extension adjacent to the propeller mounting location, said radiator comprising an integrated assembly of multiple individual sections.

19. An inverted engine for an aircraft, said engine comprising an extended crankshaft for rotating a propeller, a crankcase extension, and a propeller mounted on said crankshaft, said engine comprising a radiator mounted to the engine below said crankcase extension adjacent to the propeller mounting location, said radiator being mounted to said engine with compliant mounts.

20. An inverted engine for an aircraft, said engine being a two-stroke combustion cycle engine and comprising an extended crankshaft for rotating a propeller, a crankcase extension, and a propeller mounted on said crankshaft, said engine further comprising a radiator mounted to the engine below said crankcase extension adjacent to the propeller mounting location.

* * * * *